US012247396B2

(12) United States Patent
Downey

(10) Patent No.: US 12,247,396 B2
(45) Date of Patent: Mar. 11, 2025

(54) CEILING TILE AND ASSEMBLY CONSTRUCTED OF RECYCLED MATERIALS

(71) Applicant: CSR Industries Inc., Toronto (CA)

(72) Inventor: Paul Charles Downey, Toronto (CA)

(73) Assignee: CSR Industries Inc., Toronto (CA)

( * ) Notice: Subject to any disclaimer, the term of this patent is extended or adjusted under 35 U.S.C. 154(b) by 420 days.

(21) Appl. No.: 17/554,502

(22) Filed: Dec. 17, 2021

(65) Prior Publication Data

US 2023/0193627 A1 Jun. 22, 2023

(51) Int. Cl.
*E04B 9/04* (2006.01)
*E04F 13/16* (2006.01)

(52) U.S. Cl.
CPC ..... *E04B 9/045* (2013.01); *E04B 9/0464* (2013.01); *E04F 13/16* (2013.01); *E04B 2103/04* (2013.01)

(58) Field of Classification Search
CPC .... E04B 9/045; E04B 9/0464; E04B 2103/04; E04F 13/16
See application file for complete search history.

(56) References Cited

U.S. PATENT DOCUMENTS

| | | | | |
|---|---|---|---|---|
| 5,589,260 | A | 12/1996 | Ben Zvi et al. | |
| 5,609,816 | A | 3/1997 | Thoma et al. | |
| 6,228,478 | B1 | 5/2001 | Kliwer et al. | |
| 8,245,477 | B2 | 8/2012 | Pervan | |
| 9,169,659 | B1 | 10/2015 | Ford et al. | |
| 10,501,945 | B2 * | 12/2019 | Cernohous | B32B 37/182 |
| 2004/0013882 | A1 * | 1/2004 | Gorny | B32B 27/08 428/412 |
| 2005/0136212 | A1 | 6/2005 | Wyerman et al. | |
| 2014/0260058 | A1 * | 9/2014 | Olma | E04F 13/10 52/745.1 |
| 2015/0197943 | A1 * | 7/2015 | Ziegler | B32B 27/20 428/308.8 |
| 2015/0258716 | A1 * | 9/2015 | Hanning | B44F 9/00 264/293 |
| 2015/0267418 | A1 * | 9/2015 | Vermeulen | E04F 15/02038 52/582.2 |
| 2016/0122568 | A1 * | 5/2016 | Catchmark | C08L 1/02 106/162.2 |

(Continued)

FOREIGN PATENT DOCUMENTS

| | | |
|---|---|---|
| CN | 105482399 | 11/2018 |
| DE | 2163491 A1 | 12/1971 |

(Continued)

OTHER PUBLICATIONS

GB Intellectual Property Office, Search Report relating to Application No. GB2216780.3 dated May 5, 2023.

(Continued)

*Primary Examiner* — Forrest M Phillips
(74) *Attorney, Agent, or Firm* — Rowand LLP

(57) ABSTRACT

In an aspect a method of manufacturing a ceiling panel is described. The method may include: combining a binding agent with plastic flakes; passing the plastic flakes and the binding agent to a lamination machine; applying a force to the binding agent and the plastic flakes using the lamination machine to create a plastic sheet; and adding a decorative ceiling treatment to a first side of the plastic sheet.

11 Claims, 6 Drawing Sheets

(56) References Cited

U.S. PATENT DOCUMENTS

2020/0055277 A1* 2/2020 Hemphill ..... C04B 28/14

FOREIGN PATENT DOCUMENTS

| | | | |
|---|---|---|---|
| DE | 1008847 | A3 | 8/1996 |
| EP | 0646452 | A2 | 9/1994 |
| EP | 3073026 | A1 | 9/2016 |
| GB | 2067665 | A | 12/2022 |
| WO | 0017467 | A1 | 3/2000 |
| WO | 03012224 | A1 | 2/2003 |
| WO | 03037732 | A1 | 5/2003 |
| WO | 2011118768 | A1 | 9/2011 |
| WO | 2013182239 | A1 | 12/2013 |

OTHER PUBLICATIONS

GB Intellectual Property Office, Combined Search and Examination Report relating to Application No. GB2203920.0 dated Sep. 27, 2022.

GB Intellectual Property Office, Examination Report relating to Application No. GB2203920.0 dated Jan. 27, 2023.

BE 1008847 A3 Abstract—Supplementary Disclosures of Application No. GB2203920.1 Jan. 26, 2023.

GBPO; Combined Search and Examination Report relating to Application No. GB2315358.8 dated Dec. 5, 2023.

USPTO; Office Action relating to U.S. Appl. No. 17/209,592 dated Apr. 3, 2023.

USPTO; Final Office Action relating to U.S. Appl. No. 17/209,592 dated Nov. 1, 2023.

USPTO; Office Action relating to U.S. Appl. No. 17/209,592 dated Mar. 7, 2024.

Supplementary Disclosures of Application No. GB2203920.1 dated Jun. 22, 2023.

GB Intellectual Property Office, Examination Report relating to Application No. GB2219582.0 dated Jun. 23, 2023.

GB Intellectual Property Office, Combined Search and Examination Report relating to Application No. GB2219582.0 dated Jan. 27, 2023.

CIPO; Office Action relating to CA Application No. 3,177,981 dated Apr. 19, 2024.

* cited by examiner

CEILING TILE AND ASSEMBLY CONSTRUCTED OF RECYCLED MATERIALS

TECHNICAL FIELD

The present application relates to ceiling tiles, methods of constructing ceiling tiles and ceiling assemblies that use recycled materials.

BACKGROUND

Ceiling tiles are sometimes used in ceiling assemblies such as drop ceilings. Such ceiling assemblies may include a suspension grid, which often consists of a series of metal channels in the shape of an upside down "T" which are suspended on wires or other supporting features from overhead structures. These channels often form a series of cells which are generally of consistent size and shape and ceiling tiles may be inserted within such cells.

Ceiling tiles are often constructed of vinyl or expanded polystyrene. Such ceiling tiles are typically constructed of virgin materials (i.e., materials that are not recycled materials) and are not, themselves, recyclable.

Accordingly, there is a need for improved ceiling tiles.

DESCRIPTION OF THE DRAWINGS

Embodiments are described in detail below, with reference to the following drawings.

Like reference numerals are used in the drawings to denote like elements and features.

DETAILED DESCRIPTION OF VARIOUS EMBODIMENTS

Figure 1:
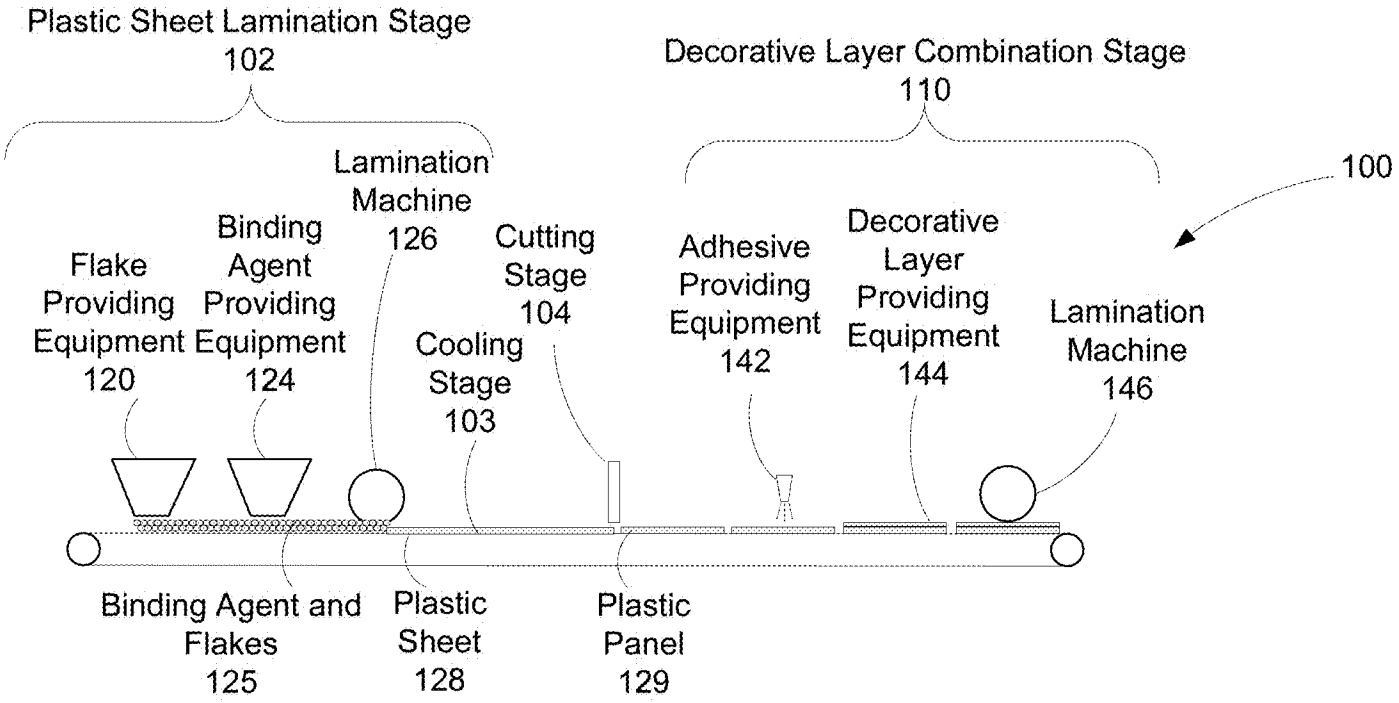
FIG. 1 is a system layout diagram of a manufacturing system in accordance with an example embodiment of the present disclosure.

In an aspect, a method of manufacturing a ceiling tile is provided. The method may include: combining a binding agent with plastic flakes; passing the plastic flakes and the binding agent to a lamination machine; applying a force to the binding agent and the plastic flakes using the lamination machine to create a plastic sheet; and adding a decorative ceiling treatment to a first side of the plastic sheet.

In at least some implementations, the ceiling tile may be manufactured using at least some recycled materials. At least some of the recycled materials may be materials that are otherwise not easily recyclable. For example, in at least some implementations, the ceiling tile may include recycled category seven (7) plastics. Such plastics may include, for example, polycarbonate plastics and/or bisphenol A (BPA), which are typically difficult to recycle.

The ceiling tile may also be manufactured using mixed plastics. That is, in may be unnecessary to separate plastics by type. In this way, plastics may be recycled for a new purpose in a cost-effective manner.

In some implementations, the decorative layer that is provided on the ceiling tile may also be a recycled product, such as 100% post consumer waste paper.

In at least some implementations, the binding agent may be a thermally activated binding agent. The lamination machine may be configured to apply heat to the binding agent and the plastic flakes while applying the force to the binding agent and the plastic flakes to cure activate the binding agent.

In at least some implementations, adding the decorative ceiling treatment to the plastic sheet may include laminating the decorative ceiling treatment to the plastic sheet using a lamination machine.

In at least some implementations, adding the decorative ceiling treatment to the plastic sheet may include adding a hot melt adhesive between the decorative ceiling treatment and the plastic sheet and curing the hot melt adhesive with the lamination machine.

In at least some implementations, the plastic flakes may include category seven (7) plastic flakes.

In at least some implementations, the plastic flakes may include any one or both of polycarbonate plastic flakes and plastic flakes containing bisphenol A (BPA).

In at least some implementations, the method may include directionally aligning the plastic flakes prior to applying the force to the binding agent.

In at least some implementations, the decorative ceiling treatment may include paper.

In at least some implementations, the paper may include one or more sound absorbing features.

In at least some implementations, the paper may be recycled paper.

In at least some implementations, the method may include applying one or both of a primer and finishing coat to the decorative ceiling treatment.

In another aspect, a ceiling tile is provided. The ceiling tile may include a plastic layer. The plastic layer may include a plurality of plastic flakes that have been adhered together using a binding agent. The ceiling tile may also include a decorative ceiling treatment.

In yet another aspect, a ceiling assembly is described. The ceiling assembly may include a frame structure and a ceiling tile supported by the frame structure. The ceiling tile may be of a type described herein. For example, the ceiling tile may include a plastic layer that includes a plurality of plastic flakes that have been adhered together using a binding agent. The ceiling tile may include a decorative ceiling treatment.

In yet another aspect, a method of installing a ceiling assembly is described. The method includes: installing a frame structure to a ceiling in a structure, the frame structure defining a plurality of cells; and placing a ceiling tile within one of the cells, the ceiling tile including: a plastic layer that includes a plurality of plastic flakes that have been adhered together using a binding agent; and a decorative ceiling treatment.

Other aspects and features of the present application will be understood by those of ordinary skill in the art from a review of the following description of examples in conjunction with the accompanying figures.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

Reference will first be made to FIG. 1, which is a system layout diagram of an example manufacturing system 100. The manufacturing system 100 or a variation thereof may be used to perform a method described herein and/or to produce a ceiling tile of a type described herein.

The manufacturing system may include one or more stages, including, for example, any one or a combination of: a plastic sheet lamination stage 102, a decorative layer combination stage 110, a cooling stage 103 and/or a cutting stage 104. While not illustrated in FIG. 1, the manufacturing system 100 may include other stages such as, for example, one or more acoustic layer combination stages and one or more finishing stages such as a paint stage.

The plastic sheet lamination stage 102 combines a binding agent with plastic pieces, such as plastic flakes, to form a plastic sheet. The plastic flakes may be recycled plastic flakes. The plastic flakes may, in at least some implementations, include category seven (7) plastic flakes. For example, the plastic flakes may include polycarbonate plastic flakes and/or plastic flakes containing bisphenol A (BPA).

The term plastic flakes as used herein includes plastic pellets. The plastics flakes may vary in size. In at least some implementations, the plastic flakes may have an average diameter and/or particle size that is between 2 and 5 millimeters (mm).

The binding agent may be an adhesive. For example, the binding agent may be a thermally activated adhesive. The thermally activated adhesive may be an adhesive that is thermally activated at a temperature that is below a melting point of the plastic pieces. In this way, the adhesive may be cured without melting the plastic pieces.

In at least some implementations, the adhesive may be a powdered adhesive. That is, the adhesive may be a solid at room temperature and may be provided in the form of small particles.

The plastic sheet lamination stage 102 may include various equipment. By way of example, the plastic sheet lamination stage 102 may include flake providing equipment 120, binding agent providing equipment 124 and a lamination machine 126. The flake providing equipment 120 may include, for example, a hopper or a feeder of another type. The flake providing equipment 120 generally provides plastic pieces, such as plastic flakes, to other equipment in the plastic sheet lamination stage 102.

The binding agent providing equipment 124 may include, for example, a hopper or a feeder of another type. While the binding agent providing equipment 124 and the flake providing equipment 120 are depicted separately in FIG. 1, in practice they may be or include integrated or shared components. For example, a common hopper or feeder may be used to provide both the plastic flakes and the binding agent. A common hopper or feeder may aid in mixing the binding agent with the flakes.

In some implementations, to provide homogeneous mixing of the plastic flakes and the binding agent, the plastic sheet lamination stage 102 may include mixing equipment that mixes in the flakes and the binding agent together. By way of example, an agitator may be used to mix the flakes and the binding agent. Additionally or alternatively, in at least some implementations the flake providing equipment 120 and the binding agent providing equipment 124 may combine the plastic flakes and the binding agent together in a manner in which the plastic flakes and the binding agent become mixed during the addition process. For example, while FIG. 1 appears to depict the flakes as being provided before the binding agent, in practice they may be provided together. For example, the plastic flakes and the binding agent may be provided concurrently on a common workspace (such as on a conveyor). By way of example, as noted above, the plastic flakes and the binding agent may be poured or otherwise placed onto the workspace, such as the conveyor, using common equipment such as a common hopper.

The plastic sheet lamination stage 102 further includes a lamination machine 126. The lamination machine 126 may be a high-pressure lamination machine. That is, the lamination machine may be capable of exerting a high pressure on the plastic flakes and the binding agent. The plastic flakes and binding agent 125 are passed to the lamination machine 126 during processing and the lamination machine 126 applies a force to the plastic flakes and the binding agent 125 in order to create a plastic sheet 128.

The lamination machine 126 may be a heated lamination machine which heats the plastic flakes and the binding agent in order to cure the binding agent. The binding agent acts to adhere the plastic flakes to one another. Further, due to the high-pressure provided by the lamination machine, a plastic sheet 128 that is quite dense may be output from the lamination machine 126.

The lamination machine 126 may, in some implementations, be capable of exerting a compressive force of up to five hundred (500) newtons per square centimeter. However, the lamination machine may be operated at forces less than this and still produce a suitable panel. In one implementation, the lamination machine 126 may provide a compressive force that is greater than one hundred and fifty (150) newtons per square centimeter. The lamination machine 126 may provide a compressive force that is less than six hundred (600) newtons per square centimeter. In one implementation, the compressive force provided by the lamination press may be in the range of two hundred (200) newtons per square centimeter and five hundred (500) newtons per square centimeter.

The lamination machine 126 may be or include a continuous press. The lamination machine 126 may include, for example, compressive rollers or plates that exert a compressive force on the plastic flakes and binding agent 125. The lamination machine 126 may be a multi-staged lamination machine in which the plastic flakes and binding agent 125 pass through a series of compression stages. For example, multiple stages of platens and/or compressing rollers may be included.

As noted above, the lamination machine 126 may apply heat to the plastic flakes and binding agent 125 during compression. Such heat may be applied in a variety of ways. For example, in at least some implementations, heat may be transferred to the plastic flakes and binding agent 125 through a heated conveyor and/or heated platens. Other techniques may be used in other implementations.

The amount of heating will depend on the binding agent used. The heat applied to the plastic flakes and binding agent 125 may be at a temperature that is less than a melting point of the plastic flakes. In at least some implementations, the heat is between ninety (90) and one hundred and forty (140)

degrees Fahrenheit. In some implementations, the heat is approximately (i.e., plus or minus 5%) one hundred (100) degrees Fahrenheit.

The lamination machine may form a plastic sheet. The plastic sheet may be between three (3) millimeters and fifty (50) millimeters thick, for example. However, the thickness may depend on the compression force that is applied.

The plastic sheet lamination stage 102 may include features or equipment in addition to the equipment illustrated in FIG. 1. For example, while not illustrated in FIG. 1, in at least some implementations, the plastic sheet lamination stage 102 may include a pre-press which is used to apply some compression to the plastic flakes and binding agent 125 before they are passed into the lamination machine 126. The amount of compression may be much less than the compression provided by the lamination machine 126 itself. The pre-press may be used to compress the plastic flakes and binding agent 125 to a desired thickness. The desired thickness may be a thickness that is compatible with the lamination machine 126. The pre-press may compress the plastic flakes and the binding agent in the absence of heat. For example, the pre-press may compress the plastic flakes and binding agent at room temperature such that the binding agent 125 is not activated through operation of the pre-press.

Additionally or alternatively, in at least some implementations, the plastic sheet lamination stage 102 may include alignment equipment. The alignment equipment may be configured to directionally align the plastic flakes. For example, the alignment equipment may be configured to align the plastic flakes such that a large portion of the plastic flakes become aligned in a common direction. That is, the plastic flakes may be aligned by grain direction. The alignment equipment may include, for example, a fluidized bed. For example, the plastic flakes may be placed in a chamber and air may be blown into the chamber. As the plastic flakes settle, they have a tendency to settle in a common direction such that the plastic flakes become directionally aligned.

The manufacturing system 100 or a portion thereof may include one more conveyors which pass workpieces and/or materials within a stage. In some implementations, the conveyors may pass workpieces and/or materials between stages. In some implementations, the manufacturing system 100 or a portion thereof may be configured for continuous processing.

The manufacturing system 100 may include other stages. For example, the manufacturing system 100 may, additionally or alternatively, include a decorative layer combination stage 110, a cooling stage 103 and/or a cutting stage 104. Further, other stages apart from those illustrated in FIG. 1 may be included, such as an acoustic layer combination stage, a paint stage, or a stage of another type.

A plastic sheet 128 that is output from the lamination machine 126 may be cut at a cutting stage 104. The cutting stage 104 may cut or otherwise form the plastic sheet 128 into a plastic panel 129.

While a single cutting stage 104 is illustrated in FIG. 1, in practice the manufacturing system 100 may include multiple cutting stages. For example, in some implementations, a first cutting stage may cut the plastic sheet along one side and a second cutting stage may cut the plastic sheet along another side.

The cutting stage 104 may be or include a shearing machine.

In at least some implementations, the manufacturing system 100 may include a cooling stage 103. The cooling stage may be before the cutting stage 104. The cooling stage may be used to allow the plastic sheet 128 to cool down following the heating in the lamination machine 126. Such cooling may allow the plastic sheet to harden and to set in a rigid form prior to the cutting. In some implementations, the cooling stage may employ active cooling equipment such as, for example, a fan. In other implementations, the cooling stage 103 may not employ active cooling equipment and cooling may, instead, be accomplished by exposing the plastic sheet to ambient air until it is cooled down. The amount of cooling required may depend on the binding agent and/or plastic flakes used. In at least some implementations, the cooling may reduce the temperature from between 10 degrees Fahrenheit and 30 degrees Fahrenheit.

The cutting stage 104 is, in the example illustrated, situated prior to the decorative layer combination stage 110. However, in other implementations, the cutting stage 104 may be situated elsewhere. For example, the cutting stage 104 may be situated after the decorative layer combination stage 110.

After a plastic sheet 128 has been formed, it may be passed to the decorative layer combination stage 110. More particularly, in some implementations, the manufacturing system 100 may be configured to manufacture a ceiling tile that is integrated with a decorative layer. The decorative layer may be a decorative ceiling treatment and the decorative layer may be referred to as a decorative ceiling treatment herein. The decorative ceiling treatment may be a variety of types. By way of example, the decorative ceiling treatment may be or include paper. The paper may, in some implementations, be recycled paper. For example, in an implementation, the paper may be one hundred percent post consumer waste paper in some implementations.

The decorative layer may be a white layer in some implementations so that the ceiling tile resembles a typical ceiling.

The decorative layer may be or include gypsum board paper. That is, the decorative layer may be a paper typically used on gypsum board, such as the exposed surface paper.

The decorative layer may include one or more sound absorbing features. By way of example, the sound absorbing features may be or include one or more of: perforations, dimples, divots, and/or an applied surface treatment such as a popcorn ceiling treatment. The sound absorbing features may be applied to the paper (or other decorative layer) before the paper (or other decorative layer) is attached to the plastic sheet or the sound absorbing features may be applied after the decorative layer is attached to the plastic sheet. For example, the manufacturing system 100 may include a sound absorbing feature application stage.

Other decorative layers may be used apart from those listed herein. In order to apply the decorative layer to the plastic sheet or panel, the manufacturing system 100 may include a decorative layer combination stage 110. The decorative layer combination stage 110 may include adhesive providing equipment 142, decorative layer providing equipment 144 and/or a lamination machine 146. The adhesive providing equipment may apply an adhesive to a side of the plastic panel.

The adhesive providing equipment 142 applies an adhesive to a first side of the plastic sheet 128. The adhesive may be, in at least some implementations, a hot melt adhesive. In an implementation, the adhesive may be an epoxy polyester adhesive. Such adhesives combined unique properties of thermoset and thermoplastic resins, are environmentally friendly, cost effective, and provide a good adhesion to a variety of substrates and offer a high degree of thermal resistance. In another implementation, the adhesive may be an ethyl vinyl acetate (EVA) adhesive. Such adhesives provide a wide viscosity range, and are available with flame retardant properties. In another implementation, the adhesive may be a thermo-plastic polyurethane (TPU) adhesive. Such adhesives offer oil and grease resistance, high abrasion resistance and are phthalate and plasticizer free. Another example adhesive that may be used in some implementations is co-polyamide PA which offers high chemical resistance, good adhesion to nylon and excellent adhesion and cohesion strength. Another example adhesive is co-polyester PES, which offers high adhesion and cohesion strength, is plasticizer resistant and available with flame retardant properties. Polyethylene and polypropylene adhesives may also be used in some implementations. Such adhesives are cost effective and have good adhesion properties, have a wide viscosity range and good chemical resistance to acids and alkalines and are available with flam retardant properties. Crosslinking adhesives may also be used. Such adhesives withstand high temperatures and are useful for bonding with metals, glass, fluorocarbon and silicone finishes.

The decorative layer providing equipment 144 may be or include a material handler. The decorative layer providing equipment 144 may take various forms and the form used may depend on the type of the decorative layer. In some implementations, the decorative layer providing equipment 144 may include a roll or roller.

The decorative layer providing equipment 144 applies the decorative layer as a layer over the adhesive added by the adhesive providing equipment 142. After the decorative layer has been layered on top of the plastic panel (or plastic sheet as the case may be), it may be laminated in the lamination machine 146. The lamination machine 146 may be the same or similar to the lamination machine used to prepare the plastic sheet.

The decorative layer may be applied in other ways in other implementations. For example, in one implementation, the decorative layer may be a surface treatment that may, for example, be applied in liquid form. In some implementations, the decorative layer may be sprayed onto the plastic sheet. Further, in some implementations, the decorative layer may also function as an acoustic layer. That is, the decorative layer may improve the aesthetics of the plastic panel 129 and it may also improve sound absorption properties of the plastic panel 129. In one implementation, the decorative layer may be a popcorn textured feature (such as a popcorn ceiling texture). In some implementations, the decorative layer may be or include paint.

The manufacturing system 100 of claim 1 may be modified to add or remove various stages. For example, other stages are contemplated.

Figure 2:
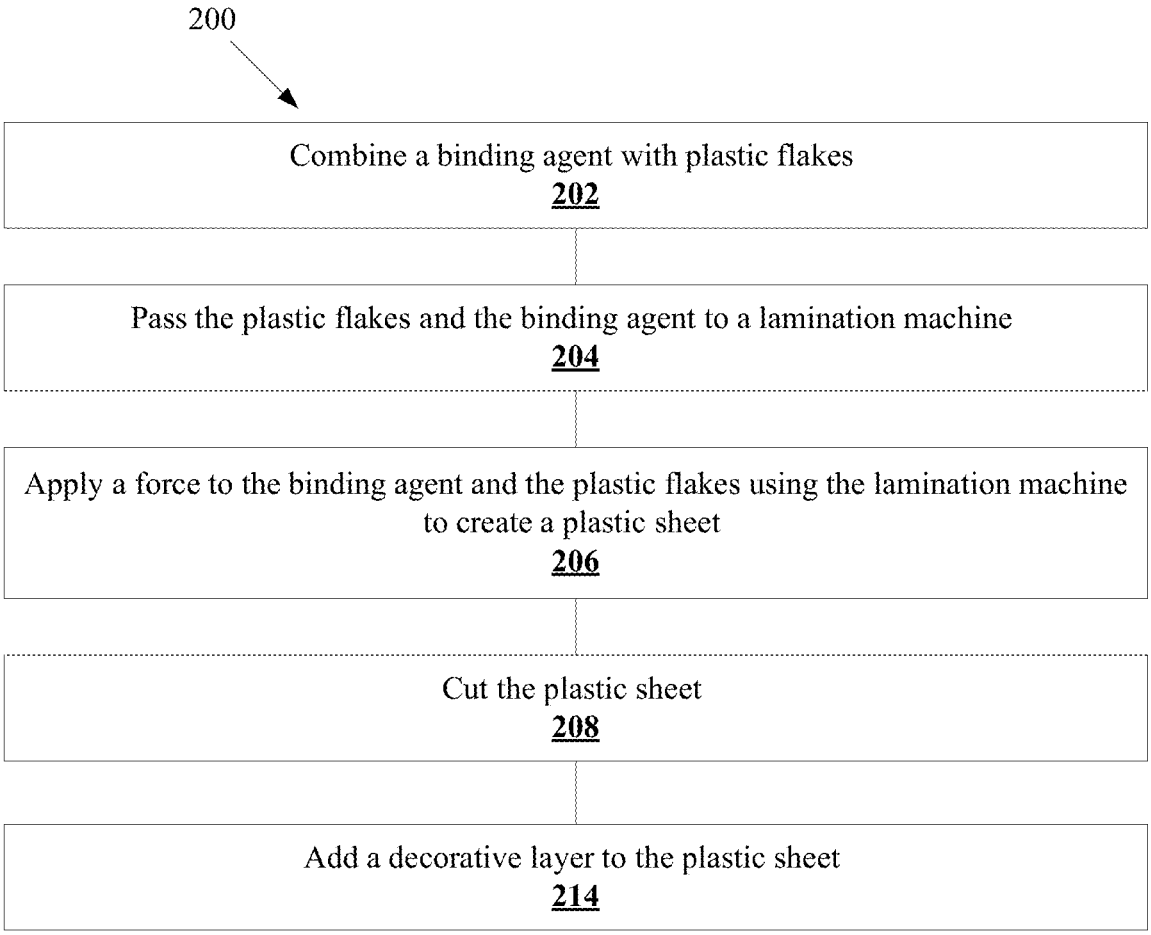
FIG. 2 is a flowchart of an example method of manufacturing a ceiling tile in accordance with an example embodiment of the present disclosure.

Reference will now be made to FIG. 2 which illustrates a flowchart of an example method 200 of manufacturing a ceiling tile. The method may be performed using a manufacturing system 100 of the type described herein or a variation thereof.

The method 200 begins at a step 202 in which a binding agent is combined with plastic flakes. The binding agent may be of the type described above with reference to FIG. 1 and the plastic flakes may be of the type described above with reference to FIG. 1. For example, the plastic flakes may include category seven (7) plastic flakes. The plastic flakes may be recycled plastic flakes. In at least some implementations, the plastic flakes may include mixed plastics. The mixed plastics may, in some implementations, be unsorted plastics. The plastic flakes may include, for example, polycarbonate plastic flakes and/or plastic flakes containing bisphenol A (BPA).

The binding agent and the flakes may be combined together using the flake providing equipment 120 and the binding agent providing equipment 124 described with reference to FIG. 1.

In some implementations, the method 200 may include a step of directionally aligning the plastic flakes. Such directional alignment may be performed using techniques described above with reference to FIG. 1. The alignment may occur prior to a step 204 of passing the plastic flakes and the binding agent to a lamination machine.

Accordingly, after the binding agent is combined with the plastic flakes, a step 204 may be performed. At step 204 the plastic flakes and the binding agent are passed to a lamination machine. Put differently, the plastic flakes and the binding agent are provided to the lamination machine. In at least some implementations, a conveyor may be used to pass the plastic flakes and the binding agent to the lamination machine.

At step 206, the lamination machine applies a force to the binding agent and the plastic flakes to create a plastic sheet. The lamination machine may be of the type described above with reference to the lamination machine 126 of the plastic sheet lamination stage.

The lamination machine may apply a force to the binding agent and, in at least some implementations, the force may be applied under heat. That is, the plastic flakes and the binding agent may be heated during the step 206. Heating may help to activate the binding agent. For example, the binding agent may be a thermally activated binding agent and the lamination machine may be configured to apply heat to the binding agent and the plastic flakes while applying the force to the binding agent and the plastic flakes to cure and/or activate the binding agent.

The method 200 may include a step 208 of cutting the plastic sheet. The cutting may be performed at the cutting stage 104 of the manufacturing system 100. For example, cutting equipment of the type described above with reference to FIG. 1 may be used to cut the plastic sheet.

The plastic sheet may be cut into panels, which may be referred to as plastic panels. The plastic sheet may be cut into a panel that is of a size and/or shape that permits easy installation in a building. For example, the plastic panels may be of a size that permits the plastic panels to be installed in cells of a suspended ceiling. By way of example, the plastic panels may be cut into squares, rectangles, triangles, hexagons, diamonds, etc. The plastic panels may be sized to fit into a frame structure of a suspended ceiling.

While not illustrated FIG. 2, in at least some implementations, the method 200 may include, prior to cutting the plastic sheet, cooling the plastic sheet. The cooling may be performed as described above with reference to the cooling stage 103 of FIG. 1. For example, the cooling may include active cooling (e.g., with a fan or other cooling device) and/or passive cooling (e.g., cooling At a step 214, the method 200 includes adding a decorative layer (i.e., the decorative ceiling treatment) to the plastic sheet. The decorative layer may be of a variety of types. For example, the decorative layer may be of a type described above with reference to FIG. 1. By way of example, the decorative layer may be or include paper. The paper may be recycled paper, in some implementations. The paper (or other decorative layer) may be or include one or more sound absorbing features. Other decorative layers may be used.

The decorative layer may be added to the plastic sheet using the manufacturing system 100 of FIG. 1. For example, the decorative layer may be added at the decorative layer combination stage 110. In at least some implementations, a lamination machine may be used to laminate the decorative layer to the plastic sheet. In at least some implementations, the decorative layer may be added to the plastic sheet using a hot melt adhesive. The hot melt adhesive may be added to the plastic sheet/panel such that it is between the decorative layer and the plastic sheet/panel. The adhesive may then be cured; for example, through heating provided by the lamination machine.

It may be noted that the order of at least some steps in the method 200 may be altered and that the method may include other steps that are not depicted or omit some of the steps that are depicted.

For example, in an implementation, the method may include a step of applying paint and/or another liquid surface treatment to the ceiling tile. For example, the method may include applying one or both of a primer and a finishing coat to the decorative ceiling treatment.

By way of further example, the method may include a step of applying a sound absorbing feature to the ceiling tile. By way of example, applying the sound absorbing feature may include one or more of: perforating an exposed surface of the decorative layer, applying a spray on coating, such as a textured coating, to the exposed surface of the decorative layer and/or laminating a sound absorbing layer to the ceiling tile (such as laminating a rubber layer to the ceiling tile).

By way of further example, in at least some implementations, the step 208 of cutting the plastic sheet may be performed at another portion of the method 200. For example, example, the plastic sheet may be cut after a decorative layer is added to the plastic sheet.

Figure 3:
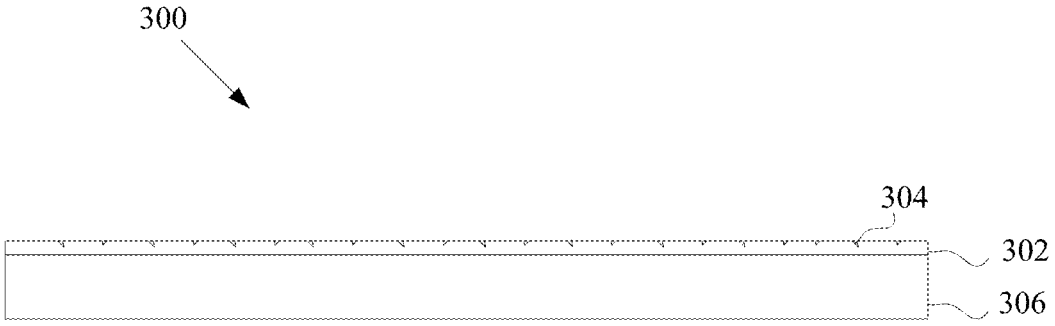
FIG. 3 is a cross sectional view of a ceiling tile in accordance with an example embodiment of the present disclosure.

Reference will now be made to FIG. 3 which illustrates a cross sectional view of an example ceiling tile 300 in accordance with an example implementation of the present disclosure. The ceiling tile 300 may also be referred to herein as decorative ceiling tile. The ceiling tile 300 may be manufactured using the manufacturing system 100 of FIG. 1 and/or the method 200 of FIG. 2.

The example ceiling tile 300 is a decorative ceiling panel which includes a decorative layer 302. The decorative layer 302 may be of a type described above. For example, the decorative layer may be or include paper such as recycled paper.

The decorative layer 302 may be coupled to another layer of the ceiling tile 300. For example, the decorative layer 302 may be coupled at an exterior of the ceiling tile such that the decorative layer 302 forms the outside of the ceiling tile.

The decorative layer 302 may include or have applied thereon one or more sound absorbing features 304 such as a texture, perforation, divot, etc. Additionally or alternatively, the ceiling tile 300 may include paint such as a primer and/or a finishing coat layer which may be applied to the decorative ceiling treatment.

The decorative layer 302 is attached to a plastic layer 306. The plastic layer 306 may be a plastic sheet of the type described herein. For example, the plastic layer may be formed using the manufacturing system 100 of FIG. 1 and, in particular, using the plastic sheet lamination stage 102. The plastic layer 306 includes a plurality of plastic flakes that have been adhered together using a binding agent. The plastic flakes may be as described above. For example, the plastic flakes may be recycled plastic flakes. The plastic flakes may include category seven (7) plastics including, for example, polycarbonate plastic flakes and plastic flakes containing bisphenol A (BPA). A single ceiling tile 300 may include various plastics. That is, more than one type of plastic may be present in a single panel.

In at least some implementations, the plastic flakes in the plastic layer 306 may be directionally aligned within the plastic layer.

Various layers of the ceiling tile 300 may be attached to one another using an adhesive (not illustrated). For example, an adhesive may be used to couple the decorative layer 302 to the plastic layer 306 (such as a plastic sheet or plastic panel). In at least some implementations, the adhesives may be or include a hot melt adhesive.

Figure 4:
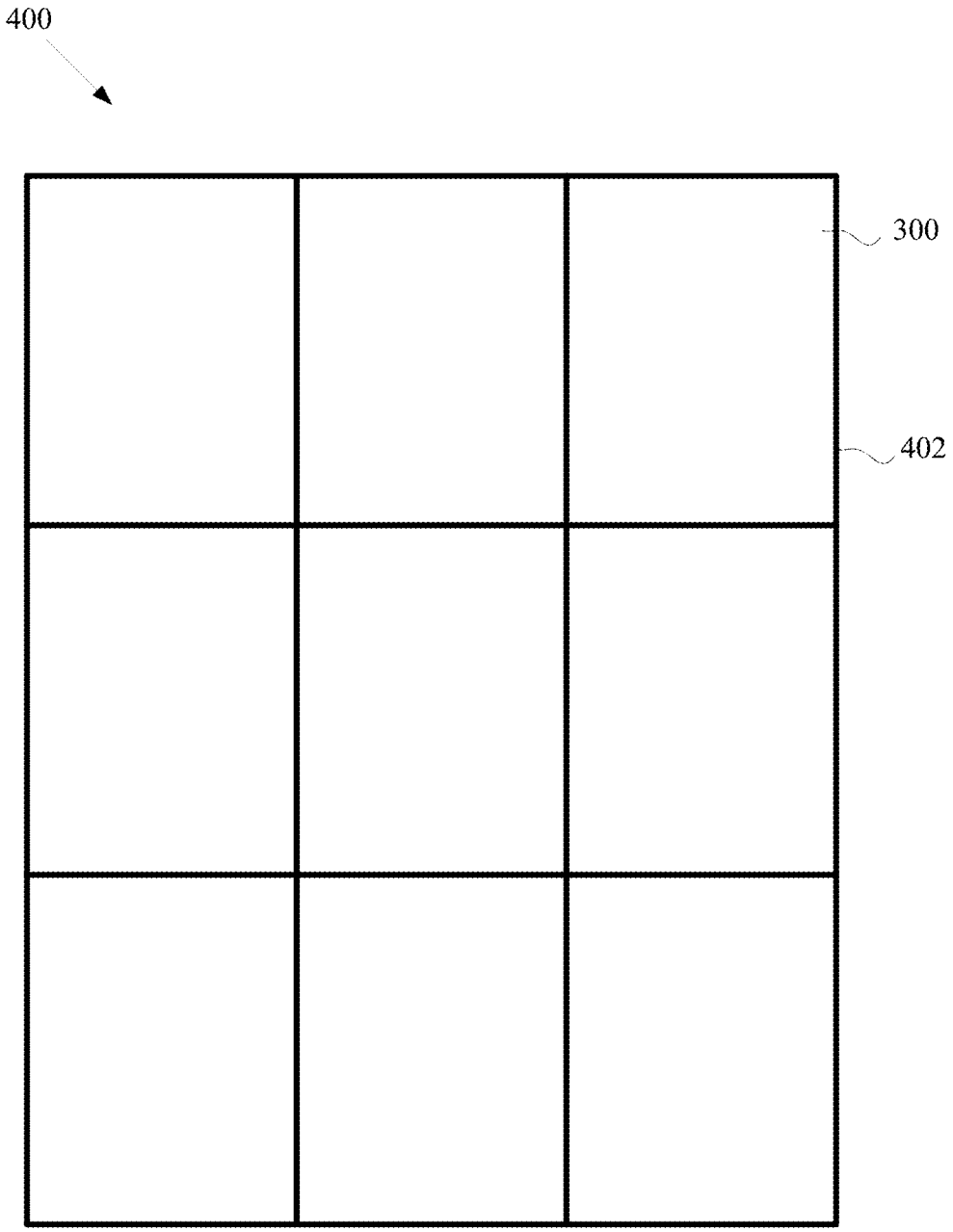
FIG. 4 is a bottom view of an example ceiling assembly in accordance with an example embodiment of the present disclosure.

Reference will now be made to FIG. 4 which illustrates a bottom view of an example ceiling assembly 400. In some implementations, the ceiling assembly 400 may be one or more of: a drop ceiling, a T-bar ceiling, a false ceiling, a suspended ceiling, a grid ceiling, a drop in ceiling, or a drop out ceiling.

Figure 5:
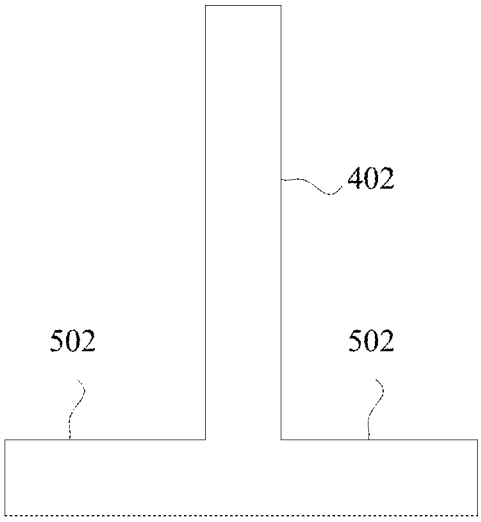
FIG. 5 is a cross-section of an example frame of the ceiling assembly of FIG. 4.

The ceiling assembly 400 includes a frame structure 402. The frame structure 402 may also be referred to as a suspension grid. The frame structure 402 may include a series of channels, such as metal channels. The channels may be or include an upside down "T", an example of which is illustrated in FIG. 5. This frame structure has supporting features 502 which may be used to support ceiling tiles 300. The ceiling tiles 300 may be of a type described herein and/or may be manufactured as described herein.

The ceiling tiles 300 are installed in the ceiling assembly 400 with the decorative layer facing down. Specifically, the ceiling tiles 300 are installed in cells defined by the frame structure 402.

Figure 6:
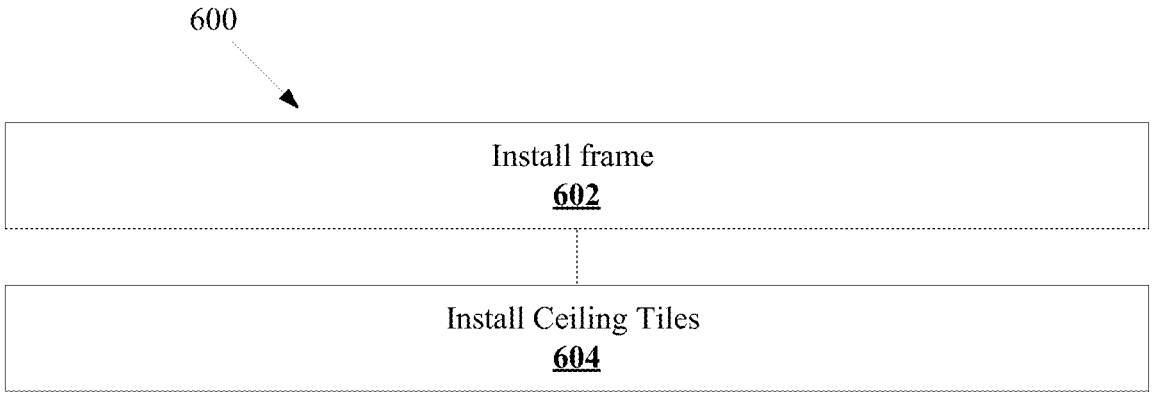
FIG. 6 is a flowchart of an example method of installing a ceiling tile in accordance with an example embodiment of the present disclosure.

Reference will now be made to FIG. 6 which illustrated a method 600 of installing a ceiling tile 300. The method 600 may include, at step 602, installing a frame structure to a ceiling in a structure (such as a building). The frame structure may be of the type described above with reference to FIGS. 4 and 5. The frame structure may include a plurality of cells.

The method 600 may also include, at step 604, placing a ceiling tile within one of the cells. The ceiling tiles may be of a type described herein. For example, the ceiling tiles may include: a plastic layer that includes a plurality of plastic flakes that have been adhered together using a binding agent; and a decorative ceiling treatment.

As noted, certain adaptations and modifications of the described embodiments can be made. Therefore, the above discussed embodiments are considered to be illustrative and not restrictive.

The invention claimed is:

1. A method of manufacturing a ceiling tile, the method comprising:

combining a binding agent with plastic flakes;

passing the plastic flakes and the binding agent to a lamination machine;

applying a force to the binding agent and the plastic flakes using the lamination machine to create a plastic sheet; and attaching gypsum board paper to a first side of the plastic sheet.

2. The method of claim 1, wherein the binding agent is a thermally activated binding agent and wherein the lamination machine is configured to apply heat to the binding agent and the plastic flakes while applying the force to the binding agent and the plastic flakes to cure activate the binding agent.

3. The method of claim 1, wherein attaching the gypsum board paper to the plastic sheet comprises laminating the gypsum board paper to the plastic sheet using a lamination machine.

4. The method of claim 3, wherein attaching the gypsum board paper to the plastic sheet comprises adding a hot melt adhesive between the gypsum board paper and the plastic sheet and curing the hot melt adhesive with the lamination machine.

5. The method of claim 1, wherein the plastic flakes include category seven (7) plastic flakes.

6. The method of claim 1, wherein the plastic flakes include any one or both of polycarbonate plastic flakes and plastic flakes containing bisphenol A (BPA).

7. The method of claim 1, further comprising directionally aligning the plastic flakes prior to applying the force to the binding agent.

8. The method of claim 1, further comprising applying one or more sound absorbing features to the gypsum board paper.

9. The method of claim 8, wherein the one or more sound absorbing features include one or more of perforations, dimples and divots.

10. The method of claim 1, wherein the gypsum board paper is recycled paper.

11. The method of claim 1, further comprising; applying one or both of a primer and finishing coat to the gypsum board paper.

* * * * *